United States Patent [19]

Kobayashi et al.

[11] Patent Number: 4,491,967

[45] Date of Patent: Jan. 1, 1985

[54] SYSTEMS FOR LOCATING MOBILE OBJECTS BY INDUCTIVE RADIO

[75] Inventors: Yoshinobu Kobayashi; Tamio Ueno, both of Osaka; Kozi Kanagawa, Okayama, all of Japan

[73] Assignees: Sumitomo Electric Industries, Ltd., Osaka; Mitsui Engineering & Shipbuilding Co., Ltd., Tokyo, both of Japan

[21] Appl. No.: 399,151

[22] Filed: Jul. 16, 1982

[51] Int. Cl.[3] ..... H04B 5/00; B61L 3/12

[52] U.S. Cl. ..... 455/41; 179/82; 246/63 R; 246/122 R; 246/167 R; 246/187 B; 455/55

[58] Field of Search ..... 455/41, 55; 179/82; 340/23, 21, 988; 246/34 R, 63 R, 63 C, 122 R, 167 R, 182 R, 182 B, 187 R, 187 B

[56] References Cited

U.S. PATENT DOCUMENTS

| | | | |
|---|---|---|---|
| 3,029,893 | 4/1962 | Mountjoy | 246/63 R |
| 3,728,539 | 4/1973 | Thorne-Booth | 246/187 B |
| 3,906,436 | 9/1975 | Kurauchi et al. | 246/122 R |
| 4,132,379 | 1/1979 | Schwarzwalder | 246/167 R |

FOREIGN PATENT DOCUMENTS

| | | | |
|---|---|---|---|
| 2548624 | 5/1977 | Fed. Rep. of Germany | 246/122 R |

*Primary Examiner*—Marc E. Bookbinder

*Attorney, Agent, or Firm*—Sughrue, Mion, Zinn, Macpeak, and Seas

[57] ABSTRACT

An object moves along a predetermined route adjacent a pair of inductive radio lines crossed at two predetermined intervals $P_1$ and $P_2$. A sensing device on the object senses the intervals and enables generation of an object position signal having a first code value when the interval $P_1$ is sensed and a second code value when the interval $P_2$ is sensed.

9 Claims, 10 Drawing Figures

SYSTEMS FOR LOCATING MOBILE OBJECTS BY INDUCTIVE RADIO

FIELD OF THE INVENTION

This invention relates to the field of systems for detecting the position of and controlling mobile objects.

BACKGROUND OF THE INVENTION

The present invention relates to systems involving inductive radio, particularly to position locating systems utilizing inductive radio. These systems make it possible to detect and control mobile objects, such as a train, travelling crane, etc., on running tracks. In container yards of wharfs, for instance, the installation of conventional multi-wire type lines for radio-frequency is not practical since it requires under-ground construction. In such cases a relative position locating system may be used which counts the number of crossings in the twisted-pair type inductive radio-frequency lines.

SUMMARY OF THE INVENTION

A primary object of the invention is to provide an absolute position locating system. Another object is to provide such a system which is available even in places where it is difficult to install multi-pairs of the twisted inductive radio-frequency lines. Yet another object is to provide such a system which is inexpensive to produce and simple to install.

DETAILED DESCRIPTION OF THE INVENTION

Figure 1:
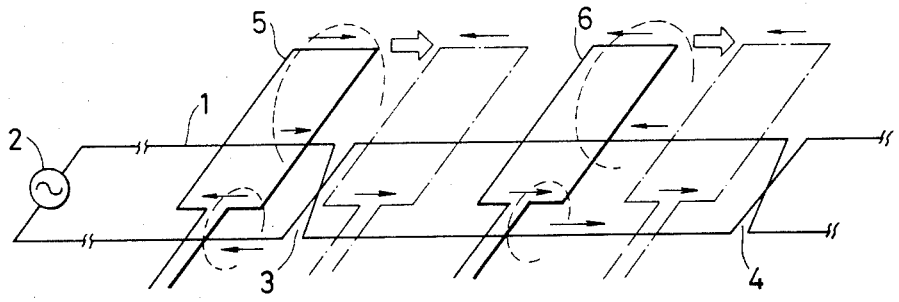
FIG. 1 is a schematic view of twisted-pair type inductive lines installed along the track of a mobile object.

As shown in FIG. 1, the twisted-pair type inductive lines 1 are installed along the track of the mobile object and a radio-frequency power supply 2 is connected to the lines 1. A pair of antenna 5, and 6 are attached to the mobile object keeping a fixed interval lengthwise of the lines. In the antennas, magnetic flux which is exemplified by the dotted lines in FIG. 1, will generate induced current flowing in the directions corresponding to those (phase) of the currents in the twisted-pair lines 1, the lines 1 having crossings 3, 4, - - - , spaced at fixed intervals whereby the phase of current flowing in the lines 1, as shown by the arrows in FIG. 1, alternates at an interval equal to that between the crossings.

Now, assuming that the phases of the induced currents in the antennas, 5, 6 and the current in the lines 1 have a relation shown by the lines in FIG. 1, the currents in the antennas, 5, and 6 are in an opposite phase to each other.

When the phase-relation between the antennas 5, 6 and the lines 1 has been varied as shown by the one-dot-and-dash lines in FIG. 1, as the mobile object travels rightwardly in the figure, the current in the antennas 5 and 6 are in the same phase.

Such phase relation between the antennas 5, 6 alters with every passage of the antennas, i.e., the mobile object, through the crossings. Hence, number of the phase alternations is counted to thereby obtain the number of crossings through which the mobile object has passed, thus indicating the relative position of the mobile object.

In the above case, however, only the relative position of the mobile object is determined along the travelling route, and an additional sensing method is required to determine an absolute position. A typical way of detecting the absolute position of a mobile object is to install a plurality of twisted-pair type inductive lines for radio-frequency with different intervals between crossings and with different frequencies allocated so that the combination of the phases of induced currents in the antennas and sensing for each twisted pair of lines indicates of the absolute location of the mobile object.

In the above case, however, the relative position of the mobile object along its travelling route can be determined by conventional lines located along its travelling route and other lines for sensing the absolute location of the object must also be installed.

A typical example of the method for detecting the absolute position of a mobile object on the predetermined travelling route is carried out by installing a plurality of a twisted-pair type inductive lines in parallel to the travelling line of the moving object and by detecting the combination of phases of the induced currents in the antennas for each signal line installed.

A typical means for detecting the absolute position of a mobile object on a travelling route is to combine the phase relations of the induced currents in an antenna, for each of the twisted pair type inductive lines. In this case, some specific signal frequency will be allocated to each portion of the line.

Another absolute position detecting method for the mobile object is illustrated in FIG. 1. In this case, some signal sources are located at the specific positions on the travelling route of the object with the abovementioned detecting lines for the relative position of the object. The presence of the object is simply determined when antennas detect the specific signal from the source for the predetermined zone on the travelling route.

Such method, however, requires signal sources to be installed along the inductive frequency lines, and moreover needs frequency discriminators which will increase the installation costs and will cause difficulties for maintenance, especially if a large number of detecting zones exist.

Figure 2:
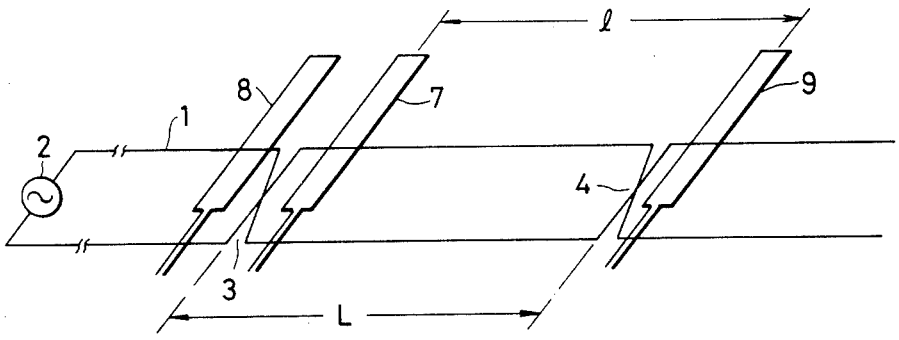
FIG. 2 is a schematic view showing the positional relationship between signal sensing antennas and twisted-pair type inductive radio-frequency lines.

This invention will be described in detail according to the drawings. Referring to FIG. 2, the positional relation between signal sensing antennas and the twisted-pair type inductive radio frequency lines 1 is shown, in which reference numeral 7 designates a reference antenna, 8 designates an auxiliary antenna, 9 designates a comparison antenna, 2 designates a radio-frequency power supply, and 3 and 4 designate the crossings of the line 1, the reference antenna 7 and the comparison antenna 9 being attached to a mobile object (not shown in the Figure) keeping a distance l along the lines 1. The crossings in lines 1 are spaced at the predetermined interval L or 2L: two times the interval L, the distance l being set in a range to meet the relation of $L \leqq l \leqq 2L$.

Figure 3:
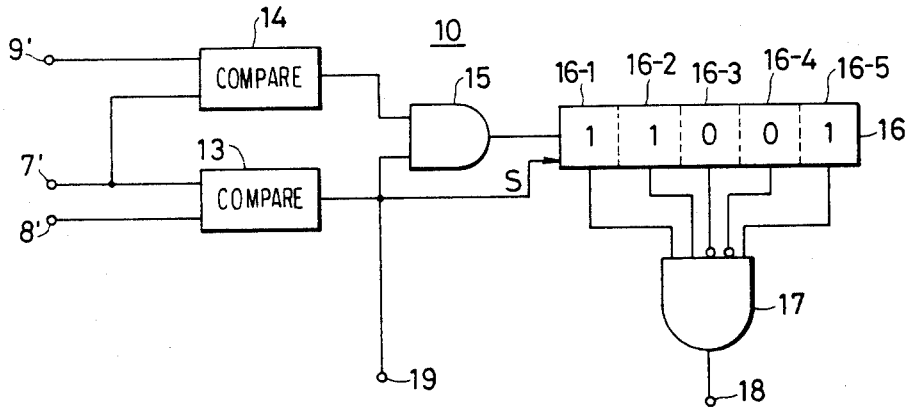
FIG. 3 is block diagram of a sensor attached to antennas.

FIG. 3 shows a block diagram of a sensor 10 attached together with antennas 7, 8 and 9 in FIG. 2 to a mobile object and which receives outputs from the above three antennas at input terminals 7', 8' and 9'. Reference numeral 13 designates a phase comparator which compares the signal phases on input terminals 7' and 8' and outputs a digital value "1" or "0" corresponding to the comparison results of whether the signals are in the opposite phase, respectively or in the same phase. Reference numeral 14 designates a phase comparator which compares the signal phases on input terminals 7' and 9' and outputs digital value "1" or "0" corresponding to the comparison results of whether the signals are in the opposite phase or in the same phase, respectively. These phase comparators also serve as an analog/digital converter generating digital signals corresponding to the analog comparison results. Reference numeral 15 designates an AND gate, 16 designates a shift register of five stages given an output of AND gate 15 and a shift pulse S from phase comparator 13, and 17 designates an AND gate for decoding the contents of the shift register 16.

Assuming that the antennas 7, 8 and 9 are positioned as shown in FIG. 2 following the movement of the mobile object, since antennas 7 and 8 are positioned at both sides of the crossing point 3, the induced currents in the antennas are in opposite phase to each other, so that the phase comparator 13 in FIG. 3 feeds digital signal "1" to one input terminal of AND gate 15 and a shift pulse S to the shift register 16.

The antennas 7 and 9 are similarly positioned at both side of the crossing 4 so that the induced currents in the antennas are in opposite phase to each other whereby the phase comparator 14 in FIG. 3 outputs digital signal "1". The AND gate 15, which is given "1" signals from both comparators, outputs "1" to the shift register 16 so that one additional "1" signal is read into the shift register.

On the other hand, when the interval between the crossings 3 and 4 in FIG. 2 is 2L, and when the antennas 7 and 8 are located on either side of a crossing, the phase comparator 13 outputs signal "1". As there is no crossing between the antennas 7 and 9, the currents therein are in the same phase and the phase comparator 14 outputs "0".

Figure 4:
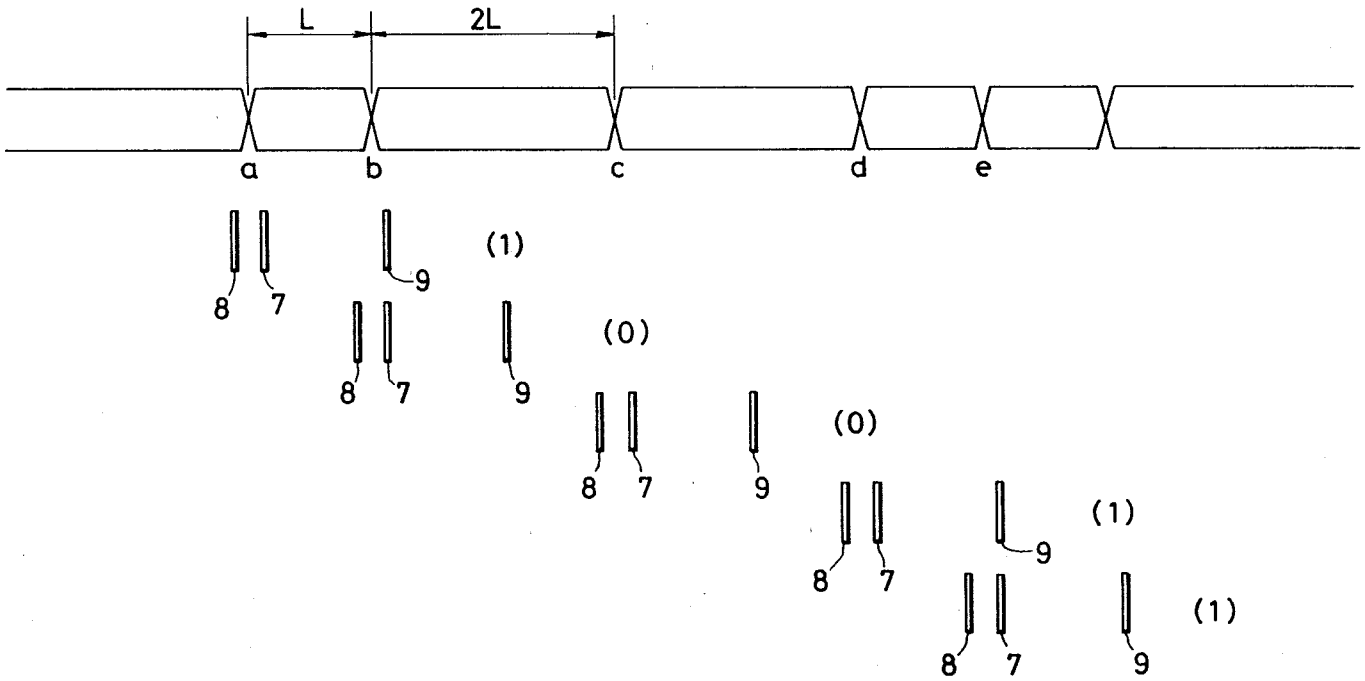
FIG. 4 is schematic diagram showing an example of an arrangement of crossings.

FIG. 4 shows an example of an arrangement of the crossings a, b, c, and d. A pattern of combination of intervals between crossings in the twisted-pair type inductive radio-frequency lines 1 and variations in an arrangement of antennas 7, 8, and 9 are illustrated.

When the antennas 7, 8 and 9 move rightwardly through the above lines 1, positioning of the antennas vs the crossings are shown downwardly in the figure. The figure also indicates that the relative spaces between the antennas are kept unchanged during their movement on the route. When the antennas 7 and 8 are located between crossings, no reading will be input to the shift register, and when they are placed on the opposite sides of a crossing a "1" or "0" depending on the position of antennas 7 and 9 will be input to the shift register. If the antennas 7 and 9 are between crossings then the phase comparator 14 outputs a "0" signal. When the antennas 7 and 9 are located on opposite sides of a crossing then the phase comparator outputs a "1" signal.

Thus, each time the reference antenna 7 passes a crossing, the shift register 16 shows readings of "1" or "0" depending on whether the antenna 7 and 9 are positioned between crossings or not. In FIG. 3, the respective columns 16-1, 16-2, . . . , 16-5 of the shift register 16 show "1", "1", "0", "0" and "1" respectively.

Hence, when the antennas 7 and 8 are presently positioned across the crossing e, i.e., the antenna 7 passes the crossing e, the AND gate 17 outputs a digital signal "1" to an output terminal 18. The present location of the antennas and also that of the mobile object will be displayed on the shift register by the combination of the digital codes which represent the absolute address of the object on the travelling route.

The intervals between crossings, outside the absolute position detecting area on the route of the object are set to a constant length larger than the distance between the antennas 7 and 9, whereby the phase comparator 14 always outputs a "0" signal and the readings on the shift register 16 will always become "0". On the contrary, each time when the reference antenna 7 passes a crossing, the phase comparator 13 outputs a "1" signal to the terminal 19 thereby providing a location detecting signal with the moving object.

In FIG. 3, the AND gate 15 can be eliminated and the output terminal of the phase comparator 14 can be connected directly to the shift register 16, thereby enabling the output from the phase comparator 13 to be used as a drive signal for the phase comparator 14. The phase comparison of the induced currents in the antennas 7 and 9 will result in digital signals "1" or "0", only when the reference antenna 7 passes a crossing as shown in FIGS. 2 and 4.

When the alignment of the antennas 7 and 8 are altered in FIG. 2, the comparison of the phases of the induced currents in the antennas 7 and 9 can be carried out just before the reference antenna 7 has reached a crossing, instead of just after the reference antenna has passed a crossing.

In this case, the phase comparison circuit 14 is designed so as to output the digital signal "1" or "0", depending on whether the phases of the induced currents in the antennas 7 and 9 are in the same phase or not, i.e., depending on the presence of the crossing 4 between the antennas 7 and 9, respectively.

In this way the address information about the mobile object is stored as "11001" in the shift register in FIG. 3 and thus enables the AND gate 17 to output signal "1" to the terminal 18.

Figure 5:
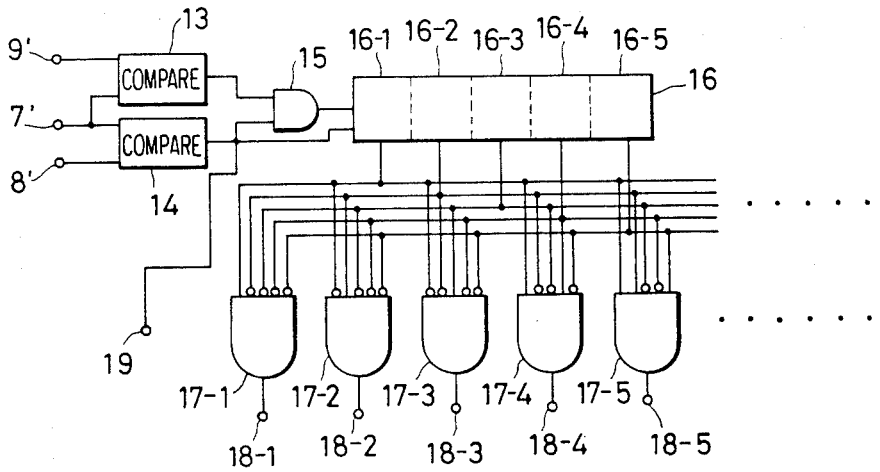
FIG. 5 is a schematic view of a preferred embodiment of the invention.

Another example of the preferred embodiment of this invention is shown in FIG. 5. In the block diagram 17-1, 17-2, 17-3, . . . 17-5 are AND gates, and the other elements with numerals as equivalent to those in FIG. 3 are illustrated.

Figure 6:
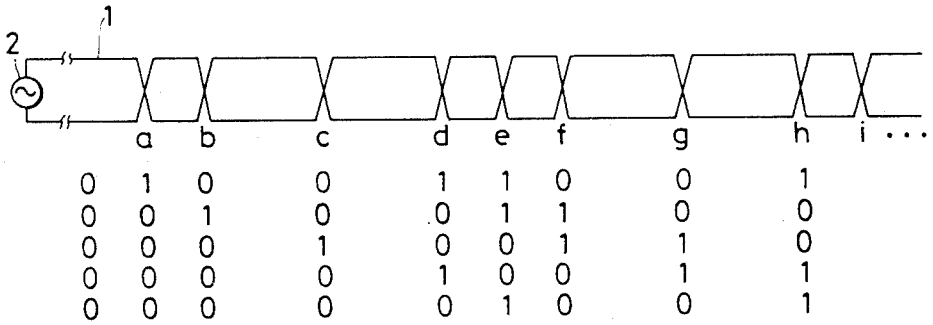
FIG. 6 is a schematic view showing an example of an arrangement of crossings within the absolute location.
Figure 7A:
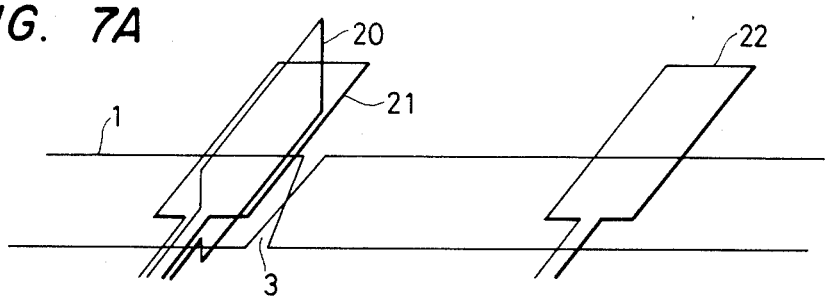
FIG. 7A is a schematic view of portion of another preferred embodiment of the present invention showing an arrangement of antennas.
Figure 7B:
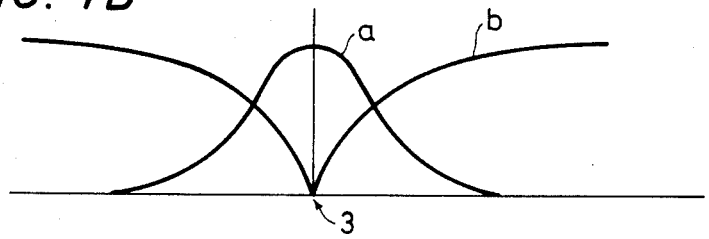
FIG. 7B shows the relative power level received by the reference antenna.
Figure 7C:
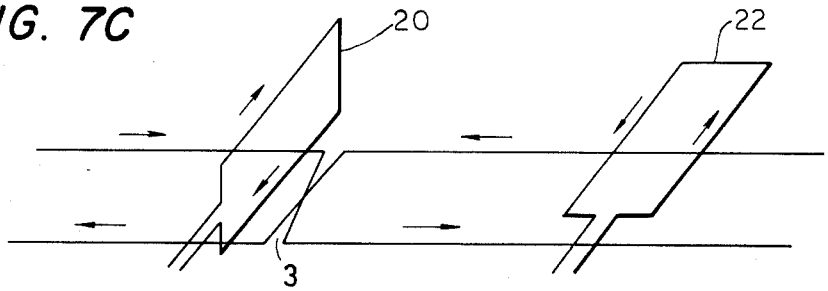
FIG. 7C shows a particular arrangement of the antennas.
Figure 7D:
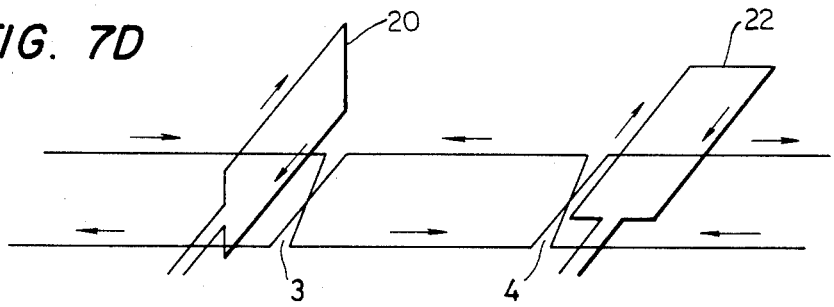
FIG. 7D shows another arrangement of the attenas.

In FIG. 6 there is shown an example of an arrangement of crossing within the absolute location, i.e., the addresses of particular areas in the twisted-pair type inductive radio-frequency lines 1. This illustrates the functions of the cirucuit in FIG. 5. In the case where the interval between the crossings in the relative location detecting zone is designed to be larger than the interval between the aforementioned antennas 7 and 9, the shift register 16 maintains the reading of "0" in the relative location detecting area and therefore the address is kept unchanged as (00000) until the reference antenna 7 passes the crossing a in FIG. 6.

Thereafter, the first column of the shift register 16-1 shows "1" when the reference antenna 7 passes the crossing a and consequently the terminal 18-1 at the AND gate 17-1 outputs the signal "1". Similar operations take place when the antenna 7 passes the crossings b, c, and so on and the AND gates 17-2, 17-3, 17-4, . . . in FIG. 5 output "1" to the corresponding terminals 18-2, 18-3, 18-4 . . . respectively. Hence, the address of the mobile object is determined at every crossing a, b, c, . . . on the travelling route of the object.

Another preferred embodiment of the invention is shown in FIG. 7, in which numeral 20 designates a reference antenna, 21 designates an auxiliary antenna, 22 designates a comparison antenna, 1 designates a twisted-pair of inductive radio-frequency lines, and 3 and 4 are crossings on the route of the travelling object. Reference antenna 20, as shown in FIG. 7-A, is located perpendicularly to the lines 1, and the auxiliary antenna 21 and the comparison antenna 22 are parallel to the lines 1.

FIG. 7-B shows in the vicinity of the crossing 3 the power level a received by the reference antenna 20 and the an power lever b of the induced currents on the antennas 21 and 22. The reference antenna 20 is vertically positioned and receives maximum power at the crossing 3 with the power lever diminishing to zero as it leaves the crossing point. The antennas 21 and 22 receive almost zero power at the crossing 3 and gradually the power level increases to a constant value as it leaves the crossing point.

On the other hand, the phases of the induced currents in the reference antenna 20 and comparison antenna 22 are either in the same phase or of opposite phase, depending on whether the crossing 4 is present between them or not.

The reference antenna 20, the auxiliary antenna 21 and the comparison antenna 22 are connected to the input terminals 7', 8' and 9' in FIG. 3 respectively, where the phase comparators 13 and 14 therein are replaced by level comparators which are equivalent thereto in their function. When the levels differ, the level comparator 13 outputs "1" to one of the two input terminals of the AND gate 15, to the shift pulse terminal of the shift register 16, and to the output terminal 19. Similarly, when the levels differ the level comparator 14 outputs "1" to the other input of the AND gate 15. The other components in FIG. 3 function in the same manner as in the previously mentioned examples.

In FIG. 7, the antennas 20 and 22 may be set with an interval equal to the minimum interval of L in the lines 1. The levels of the induced currents in both the antennas 20 and 22 will be compared only when the antenna 20 is positioned in the vicinity of the crossings, since at this time the induced currents in antennas 20 and 21 will be different and their level comparison will result in a "1" output to AND gate 15, shift pulse terminal S and output terminal 19. The results of the comparison in such configuration are shown in FIG. 7-C for the case in which a long interval occurs between crossings. The levels at the antennas 20 and 22 are about equal so that the comparison results are "0"s. In FIG. 7-D, where the antenna 22 is positioned at the crossing 4, the induced current level in antenna 22 is almost zero and the comparison results in a "1" output.

As described above, the spaces between the neighboring two crossings in the inductive lines may be expressed by two values, namely p1 and p2, where p2 is larger than p1. In a preferred embodiment of the present invention, the only requirement for p1 and p2 is to satisfy the following equations:

$$l/2 < p1 \leqq l \text{ and } p2 > l \quad (1)$$

or $$p1 \leqq l < p2 \text{ and } l < 2p1 \quad (2)$$

These conditions imply that p1 is larger than l/2 so that the number of crossings which are present between the two antennas of 7 and 9 are kept unchanged along the lines. For instance one crossing may exist in the case of FIG. 2, and two crossings always exist when the antennas 7 and 8 are exchanged in position along the inductive lines. Another implication of the above equation is that p1 is less than or equal to l in order to detect the absolute position of the mobile object. Other implications of the above equations are that p1 is less than l when the absolute address of the mobile object must be detected along the inductive lines with short distance between two neighbouring crossings. On the contrary it is required that p2 is larger than l when detection of the absolute position of the object is necessary along the inductive lines with long distance between two neighbouring crossings.

There have been shown various modifications of the comparing circuitry. There have been shown various modifications of the circuitries for comparing the phases or levels of the currents induced in the reference antenna and in the auxiliary antenna. In brief, they operate as a proper detecting means for detecting the position of the reference antenna in the vicinity of the crossing and actuate the comparator or its output which compares the phase or the levels of the current induced.

As described above in detail, the purpose of the present invention is to provide simple and economical means for detecting an absolute position of a mobile object on its travelling lines. The combination of large and small intervals between crossings of the radio-frequency inductive lines and the spacing between the reference and comparison antennas is used to determine the absolute position of the mobile object. It should be emphasized that many modifications can be done within the scope of the present invention.

While the invention has been described in detail and with reference to specific embodiments thereof, it will be apparent to one skilled in the art that various changes and modification can be made therein without departing from the spirit and scope thereof.

What is claimed is:

1. A system for generating a signal representing the location of a mobile object along a predetermined route, said signal being in the form of a succession of first and second code values, said system comprising:

a pair of twisted inductive radio lines installed along said predetermined route, said lines crossing one another at intervals with each interval having one of two predetermined lengths $p_1$ and $p_2$;

sensing means mounted on said mobile object for sensing the lengths of a plurality of successive ones of said intervals as said mobile object travels along said predetermined route; and signal generating means responsive to said sensing means for generating a first code value when an interval length $p_1$ is detected and for generating a second code value when an interval of length $p_2$ is detected.

2. A system as claimed in claim 1, wherein said sensing means comprises at least two antennae spaced a predetermined distance l from one another, and determining means for determining whether or not a crossing occurs between said at least two antennae.

3. A system as claimed in claim 2, wherein said sensing means further comprises a third antenna adjacent said first antenna and wherein said determining means comprises first comparison means for comparing output signals from said first and third antennae to detect a first crossing and second comparison means for comparing output signals from said first and second antennae to determine the length of the interval between said first crossing and an adjacent crossing.

4. A system as claimed in claim 3, wherein said first and second comparison means compare the phases of their respective input signals, and wherein said generating means comprises means for generating a crossing detection signal in response to a phase difference between output signals of said first and third antennae, and second means responsive to said crossing detection signal for generating said first code value when said first and second antenna output signals have the same phase and for generating said second code value when said first and second antenna output signals have different phases.

5. A system as claimed in claim 3, wherein said first and second comparison means comprise level comparators for comparing the levels of their respective input signals, and wherein said generating means comprises first means for generating a crossing detection signal in response to a predetermined level difference between output signals of said first and second antennae, and second means responsive to said crossing detection signal for generating said first and second code values in accordance with the level comparison of output signals from said first and second antennae.

6. A system as claimed in claim 2, wherein said predetermined distance l satisfies the following equations:

$$P_1 \leqq l < p_2 \text{ and } l < 2p_1.$$

7. A system as claimed in claim 2, wherein said sensing means further comprises detection means for detecting the presence of one of said two antennae in the vicinity of any one of said crossings, and said determining means is responsive to an output signal from said detection means for determining the presence or absence of a crossing between said at least two antennae when said one antenna is in the vicinity of a crossing.

8. A system as claimed in claim 7, further comprising means for storing a succession of output signals from said signal generating means.

9. A system as claimed in claim 8, further comprising discriminating means responsive to the contents of said means for storing at any given time for determining the location of said mobile object along said predetermined route at said time.

* * * * *